US006705743B1

(12) United States Patent
Elembaby et al.

(10) Patent No.: US 6,705,743 B1
(45) Date of Patent: Mar. 16, 2004

(54) DISPLAY LIGHT APPARATUS

(76) Inventors: Ismail A Elembaby, 2 Blackpine Ct., Holtsville, NY (US) 11742; Anwar Khedr, 86 W. 19th Street, Deer Park, NY (US) 11729

( * ) Notice: Subject to any disclaimer, the term of this patent is extended or adjusted under 35 U.S.C. 154(b) by 0 days.

(21) Appl. No.: 10/199,435

(22) Filed: Jul. 18, 2002

(51) Int. Cl.[7] ..... F21V 1/00

(52) U.S. Cl. ..... 362/249; 362/391; 362/252; 362/351

(58) Field of Search ..... 362/249, 391, 362/252, 235, 351

(56) References Cited

U.S. PATENT DOCUMENTS

| | | | | |
|---|---|---|---|---|
| 1,321,521 A | | 11/1919 | Green | |
| 1,485,472 A | | 3/1924 | Van Bloem | |
| 2,194,614 A | | 3/1940 | Rayburn | |
| 2,221,178 A | | 11/1940 | Best | |
| 2,330,561 A | | 9/1943 | Dietrich | |
| 2,647,985 A | | 8/1953 | Biller | |
| 3,200,371 A | | 8/1965 | Olsen | |
| 3,539,801 A | | 11/1970 | Bobrick | |
| 3,701,897 A | | 10/1972 | Pennington et al. | |
| 3,805,049 A | | 4/1974 | Frank et al. | |
| 4,135,232 A | | 1/1979 | Berkenhoff | |
| 4,259,709 A | | 3/1981 | Eddings | |
| 4,511,953 A | | 4/1985 | Fage | |
| 4,967,317 A | * | 10/1990 | Plumly | 362/31 |
| 5,311,414 A | | 5/1994 | Branham, Sr. | |
| 5,577,831 A | * | 11/1996 | Chang | 362/240 |
| 5,632,551 A | * | 5/1997 | Roney et al. | 362/249 |
| 6,288,498 B1 | | 9/2001 | Cheng | |
| 6,294,983 B1 | | 9/2001 | Lee | |
| 6,309,086 B1 | | 10/2001 | Tomlinson | |
| 6,341,440 B1 | * | 1/2002 | Lee | 40/546 |
| 6,404,131 B1 | * | 6/2002 | Kawano et al. | 362/800 |

* cited by examiner

*Primary Examiner*—Thomas M. Sember
(74) *Attorney, Agent, or Firm*—Michael I. Kroll

(57) ABSTRACT

A light display apparatus to illuminate diffused light in a variety of chosen designs including letters, objects, numerals, images, etc. Design consisting of a plurality of lights housings mounted on the back surface of the display apparatus. Light housings have light emitting bulbs that diffuse light through a light diffusing material. Plurality of lights are secured into a plastic type housing with internal diffusing material contained therein, such housing conforms to the shape of the display apparatus. Display apparatus is designed with a frontal and side surface to pass through or diffuse light to the viewer and a rear surface to secure lights, whereas side and rear surfaces may or may not pass light depending on design requirements.

3 Claims, 9 Drawing Sheets

DISPLAY LIGHT APPARATUS

BACKGROUND OF THE INVENTION

1. Field of the Invention

The present invention relates generally to display light fixtures and, more specifically, to a display light display that is comprised of a plurality of lights with the light emitting bulb positioned within a light diffusing material having the socket portion extending therefrom. The plurality of lights are anchored within a light diffusing material formed into a recognizable shape indicative of known objects or holiday icons. The device is composed of an outer housing consisting of a light diffusing material that is formed into recognizable shapes such as letters, numbers and/ or symbols that encompasses a plurality of light sources electrically connected to a switch whereby said light bulbs can be selectively energized causing the light to be diffused or refracted throughout the material thereby emanating light rays from the entire surface area.

The arrangement of lights being multi-colored, clear or have the same color. Lights can have a flasher unit for pulsation control or be constantly "on". The lamps provide a display lighting effect, which is pleasing when viewed.

2. Description of the Prior Art

There are other display light fixture devices designed for decoration. Typical of these is U.S. Pat. No. 1,321,521 issued to Green on Nov. 11, 1919.

Another patent was issued to Bloem on Mar. 4, 1924 as U.S. Pat. No. 1,485,472. Yet another U.S. Pat. No. 2,194,614 was issued to Rayburn on Mar. 26, 1940 and still yet another was issued on Nov. 12, 1940 to Best as U.S. Pat. No. 2,221,178.

Another patent was issued to Dietrich on Sep. 28, 1943 as U.S. Pat. No. 2,330,561. Yet another U.S. Pat. No. 2,647,985 was issued to Biller on Aug. 4, 1953. Another was issued to Olsen on Aug. 10, 1965 as U.S. Pat. No. 3,200,371 and still yet another was issued on Nov. 10, 1970 to Bobrick as U.S. Pat. No. 3,539,801.

Another patent was issued to Pennington et al. on Oct. 31, 1972 as U.S. Pat. No. 3,701,897. Yet another U.S. Pat. No. 3,805,049 was issued to Frank et al. on Apr. 16, 1974. Another was issued to Berkenhoff on Jan. 16, 1979 as U.S. Pat. No. 4,135,232 and still yet another was issued on Mar. 31, 1981 to Eddings as U.S. Pat. No. 4,259,709.

Another patent was issued to Fage on Apr. 16, 1985 as U.S. Pat. No. 4,511,953. Yet another U.S. Pat. No. 5,311,414 was issued to Branham, Sr. on May 10, 1994. Another was issued to Lee on Sep. 25, 2001 as U.S. Pat. No. 6,294,983 and still yet another was issued on Mar. 31, 1981 to and still yet another was issued on Oct. 30, 2001 to Tomlinson as U.S. Pat. No. 6,309,086.

U.S. Pat. No. 1,321,521

Inventor: James M. Green

Issued: Nov. 11, 1919

The invention relates to machines for lighting photographic studios and other similar work where photographic plates or film are used and one of the objects of the invention is to secure a maximum of results upon the plates or film from a minimum illumination.

U.S. Pat. No. 1,485,472

Inventor: Pual Schuyler Van Bloem

Issued: Mar. 4, 1924

The main objective of the invention is to provide a device, which will serve both as a counter, display case and desk and sign illuminator.

U.S. Pat. No. 2,194,614

Inventor: Alden G. Rayburn

Issued: Mar. 26, 1940

The present invention relates to a novel lens assembly designed to impart characteristic colors to the light emitted from each compartment of a multi-compartment light housing.

U.S. Pat. No. 2,221,178

Inventor: Frank C. Best

Issued: Nov. 12, 1940

The invention relates to motor vehicles and more particularly to lighting equipment for motor vehicles.

U.S. Pat. No. 2,330,561

Inventor: Friedrich Richard Dietrich

Issued: Sep. 28, 1943

The invention relates to a vehicle rear signal, and its objective is to enable the driver of a following car to judge his distance from the leading car.

U.S. Pat. No. 2,647,985

Inventor: David J. Biller

Issued: Aug. 4, 1953

The invention relates to illumination fixtures and louvers therefor and is more particularly directed to a louver construction to be associated with recessed ceiling fixtures to provide for a better diffusion of light emanating from the lamp bulbs installed in the fixture.

U.S. Pat. No. 3,200,371

Inventor: Stephen Olsen

Issued: Aug. 10, 1965

The present invention relates to traffic signals and is more particularly concerned with a traffic light for controlling traffic from four directions.

U.S. Pat. No. 3,539,801

Inventor: Mitchell Bobrick

Issued: Nov. 10, 1970

A ceiling mounted light fixture is formed by a pan having overlying insulating sheets forming a cluster of juxtaposed light socket openings, the sheets mounting an individual reflector aligned with each socket opening and reflectors may be integral.

U.S. Pat. No. 3,701,897

Inventor: Pennington et al.

Issued: Oct. 31, 1972

A light fixture having a light source surrounded by an opaque cylinder member having a large number of small holes therein for permitting light to pass therethrough into a set of prisms disposed in a cylinder just outside said cylinder member about its axis, said prism being elongated substantially parallel to said axis, said cylinder member being flexible to permit it to be mounted on three spokes radiating from the output rotary shaft of said motor by said spokes being received through three of said holes in said cylinder member.

U.S. Pat. No. 3,805,049

Inventor: Bruce Allen Frank et al.

Issued: Apr. 16, 1974

The apparatus produces varying color patterns on an object and comprises a plurality of color producing units connected together in assemblage. Each unit comprises a curved surface which supports a blue, a red, and a green light source. An object is supported a preselected distance from the assemblage by an associated support device. A control device connected to the light sources is adapted to selectively vary the intensity of the light sources of each one of the plurality of color producing units to obtain color patterns.

U.S. Pat. No. 4,135,232

Inventor: Hans-Peter Berkenhoff

Issued: Jan. 16, 1979

A spot-light reflector structure is made up of two reflector bodies, a main reflector body and an auxiliary reflector body both of which have a shape which is, in part, that of a paraboloid of revolution. Both reflector bodies are arranged in coaxial relation. The main reflector body has a central aperture and is nonparabolic in the region around said aperture. The auxiliary reflector body is arranged inside of the main reflector body and has an upper portion which is substantially hemispherical and has a central aperture which is arranged in coaxial relation to the central aperture of the main reflector body. The central aperture of the auxiliary reflector body is surrounded by a tubular extension which forms preferably an integral part thereof and which is in the shape of a paraboloid of revolution of considerably smaller size than that of the main reflector body.

U.S. Pat. No. 4,259,709

Inventor: Jack L. Eddings

Issued: Mar. 31, 1981

An arrangement of multi-colored randomly-flashing lamps provides a decorative lighting effect which is particularly pleasing when viewed while listening to music. The lamps are mounted in a plurality of lamp reflectors which are disposed in a honeycomb-like array which is mounted in a frame. Preferably, a series of five lamps are mounted in each reflector. A series of flashers to corresponding in number to the number of lamps in each reflector function to power the lamps in random sequence so that various colors and color blends are produced.

U.S. Pat. No. 4,511,953

Inventor: Bonnard Fage

Issued: Apr. 16, 1985

This invention is directed at a light box comprising a box-like base member and a cover. The base member has a storage compartment and a series of light chambers which are aligned with the storage chamber. The storage chamber includes a means of providing power to the source of light mounted in the light chambers. The cover is pivotally engaged to the base member by an L hinge and has an adjustable connector extending therefrom which is engageable with the base member. Each of the secondary walls has an upper side edge and a lower side edge. The upper side edge is positioned in close proximity to the opening of the base member and the lower side edge is positioned in spaced parallel relation to the upper side edge and has a notch formed therein. The notches of the secondary walls are in aligned, spaced relation to each other. A first channel is mounted in a shoulder formed at the opening to the base member and faces into the light chambers. A series of inward facing channels are mounted in the light compartment adapted to cooperate with the first channel to hold a filter or the like in parallel relation to the base. The first channel is spaced from the top side edge of the base member providing an opening into the light chambers and the bottom wall of the base member has at least one vent formed therethrough. The base has a platform portion mounted thereon within the storage chamber. The platform portion is spaced from the inner surface of the base and has a connector mounted thereon facing into the storage chamber.

U.S. Pat. No. 5,311,414

Inventor: Henry J. Branham, Sr.

Issued: May 10, 1994

An elongate housing structure having a base plate, a first planar cover plate, and a second V-shaped cover plate hingedly mounted to the first planar cover plate is provided to selectively provide viewing of Christmas tree sockets and bulbs contained within the housing structure for permanent mounting relative to an exterior surface of a dwelling.

U.S. Pat. No. 6,294,983

Inventor: Chi-Hwong Lee

Issued: Sep. 25, 2001

The present invention relates to an emergency exit light having an installation body having a light fitting and a power supply device inside thereof and an indicating board made of transparent material, words or figures sculptured on the indicating board fixed under the installation body. And the improvement is characterized by the installation body consisting of a main body formed in a squeezing manner by aluminum material, a side plate engaged at the open side of the main body and two side covers fixed at two ends of the main body. The LED is mounted on the lighting circuit board in a manner of series connection while the lighting circuit board is fixed at the lower end of the main body, and the series-connected LED is situated at the top of the indicating board. The power supply device is disposed at the top end of the main body wherein an uninterrupted circuit is fitted to a power supply circuit board. It has a transformer used to transform the mains power to be the required direct current and a set of charging battery to accumulate power for the light fitting. Accordingly, the present invention can considerably reduce the thickness, won't destroy the decoration style and has a brighter and clearer presentation effect.

U.S. Pat. No. 6,309,086

Inventor: Christine Sue Tomlinson

Issued: Oct. 30, 2001

A holiday lighting assembly, for allowing Christmas lights to be permanently mounted upon a building near the eaves of said building, and for allowing selective display of the lights during the appropriate season, comprising a housing mounted to the building. The housing has an open front, and a pair of sides. The lights are located inside the housing, extending between the sides. A front flap selectively covers the open front in order to conceal the lights. Pins on the front flap mate with slots in the sides of the housing, to allow the front flap to pivot upward and slide into the housing to allow the lights to be displayed. While these display light apparatus may be suitable for the purposes for which they were designed, they would not be as suitable for the purposes of the present invention, as hereinafter described.

SUMMARY OF THE PRESENT INVENTION

A primary object of the present invention is to provide a visual display light apparatus that is comprised of a plurality of lights with each light-emitting bulb positioned within a light diffusing material having the socket portion extending therefrom.

Another object of the present invention is to provide a display light apparatus such that the plurality of lights are anchored within a light diffusing material which is formed into an illuminated and recognizable shape indicative of known objects, letters, numbers, holiday icons, etc.

Yet another object of the present invention is to provide a display light apparatus that is composed of an outer housing consisting of mounting sockets and an inner housing of light diffusing material that conforms to the shape of the outer housing.

Still yet another object of the present invention is to provide a display light apparatus in which a plurality of lights are interconnected within the sockets of the outer housing and penetrate the inner light diffusing material.

Another object of the present invention is to provide a display light apparatus that when plugged into a power source, the ambient light is diffused or refracted within the defusing material.

Yet another object of the present invention is to provide a display light apparatus with an arrangement of lights, multi-colored, clear or of the same color, randomly flashing or constantly "on" lamps to provide a display lighting effect that is pleasing when viewed.

Other objects of this invention will appear from the following description and appended claims, reference being made to the accompanying drawings forming a part of this specification wherein like reference characters designate corresponding parts in the several views.

The present invention overcomes the shortcomings of the prior art by providing a display light apparatus that is comprised of a plurality of lights with the light-emitting bulb positioned within a light diffusing material having the socket portion extending therefrom. The plurality of lights are anchored within a light diffusing material formed into a recognizable design shape indicative of known objects or holiday icons. The device is composed of an outer housing employed to mount the light sockets and an inner light diffusing body made of light diffusing material that conforms to the shape of the outer housing. A plurality of lights are connected within the sockets of the outer housing and penetrate the inner light diff-using body. When plugged into a power source, the light is diffused or refracted within the defusing material. Light then passes to an outer casing which illuminates the light to a user. The plurality of lights can be multi-colored, clear or of the same color, randomly flashing, sequentially flashed, or constantly "on" and will provide a display lighting effect, which is pleasing when viewed.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the present invention is best defined by the appended claims.

BRIEF OF THE DRAWING FIGURES

In order that the invention may be more fully understood, it will now be described, by way of example, with reference to the accompanying drawing in which.

DESCRIPTION OF THE REFERENCED NUMERALS

Figure 1:
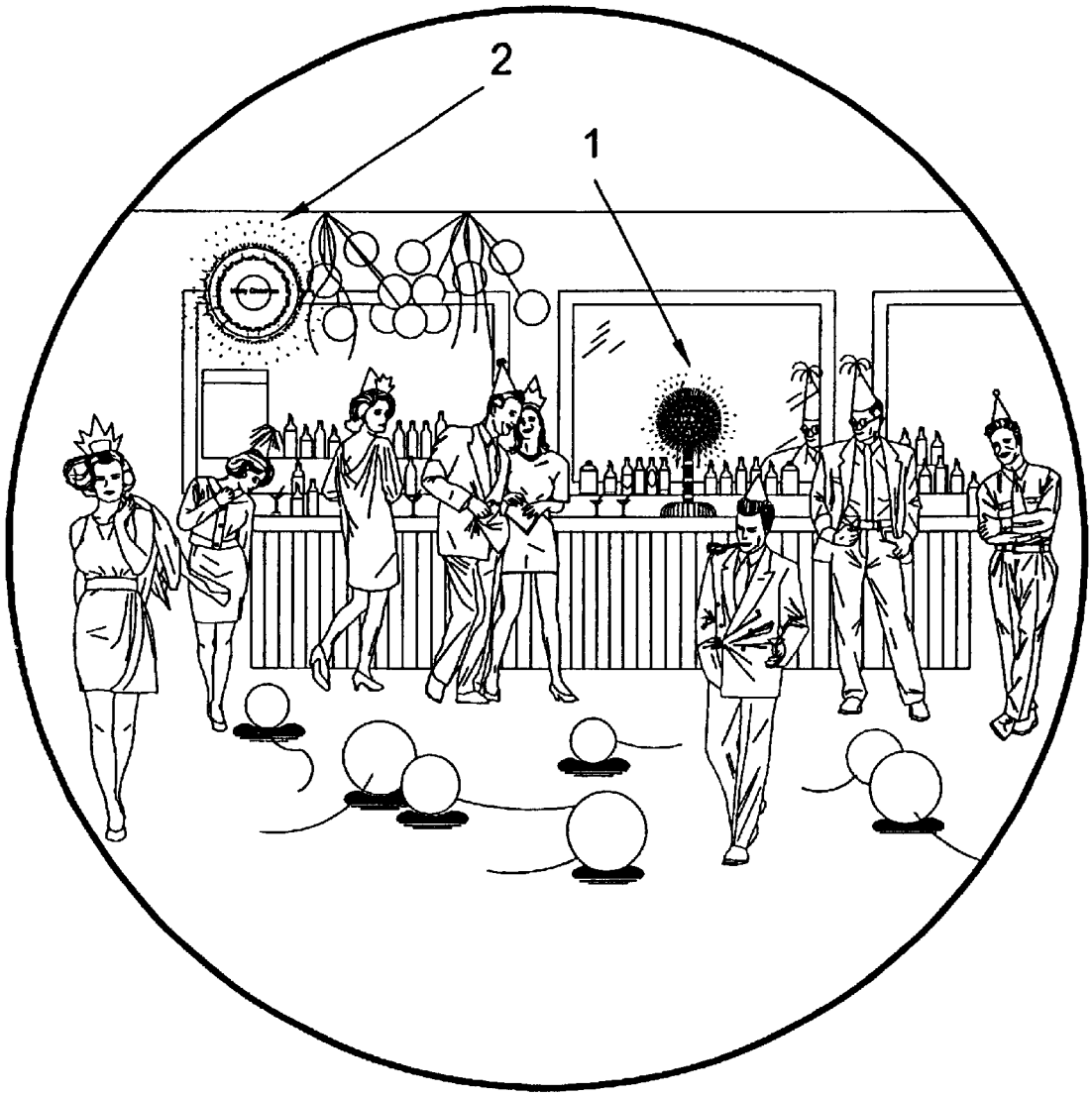
FIG. 1 is an illustrative view of the present invention in use.

Turning now descriptively to the drawings, in which similar reference characters denote similar elements throughout the several views, the figures illustrate the present invention. With regard to the reference numerals used, the following numbering is used throughout the various drawing figures.

200 perspective view of C-shaped design layout

201 exploded view of C-shaped design layout

202 cross-sectional view of bulb, housing and diffusion material

203 cross-sectional view of plastic housing with bulb

204 frontal view of C-shaped design layout

205 rear view of C-shaped design layout

206 perspective view of numeral three design layout

1 bar or table light display

2 wall light display

3 plastic housing

4 inner light diffusing body

5 bulb housing retaining socket

6 light bulb

7 light bulb housing

8 power plug
9 light bulb first power connection wire
10 light bulb second power connection wire
11 plug first power source wire
12 plug second power source wire
13 power connection prongs
14 receptacle prong receiving sockets
15 bulb acceptance hole
16 plastic housing outer viewing surface
17 plastic housing side viewing surface
18 plastic housing rear surface
19 numeral three front surface
20 numeral three side surface
21 outer plastic numeral three housing
22 inner plastic numeral three housing
23 letter "G" front surface
24 letter "G" front surface
25 outer plastic letter "G" housing
26 inner plastic letter "G" housing The following discussion describes in detail one embodiment of the invention (and several variations of that embodiment) . This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention in use. Shown are a bar or table light display 1 and a wall light display 2. Each display light apparatus is comprised of a plurality of lights with the light emitting bulb positioned within a light diffusing material having the socket portion extending therefrom. The plurality of lights are anchored within a light diffusing material formed into a recognizable shape indicative of known objects or holiday icons. The plurality of lights can be multi-colored, clear or of the same color, randomly flashing, sequentially flashing, or constantly "on" and provide a display lighting effect, which is pleasing when viewed.

Figure 2:
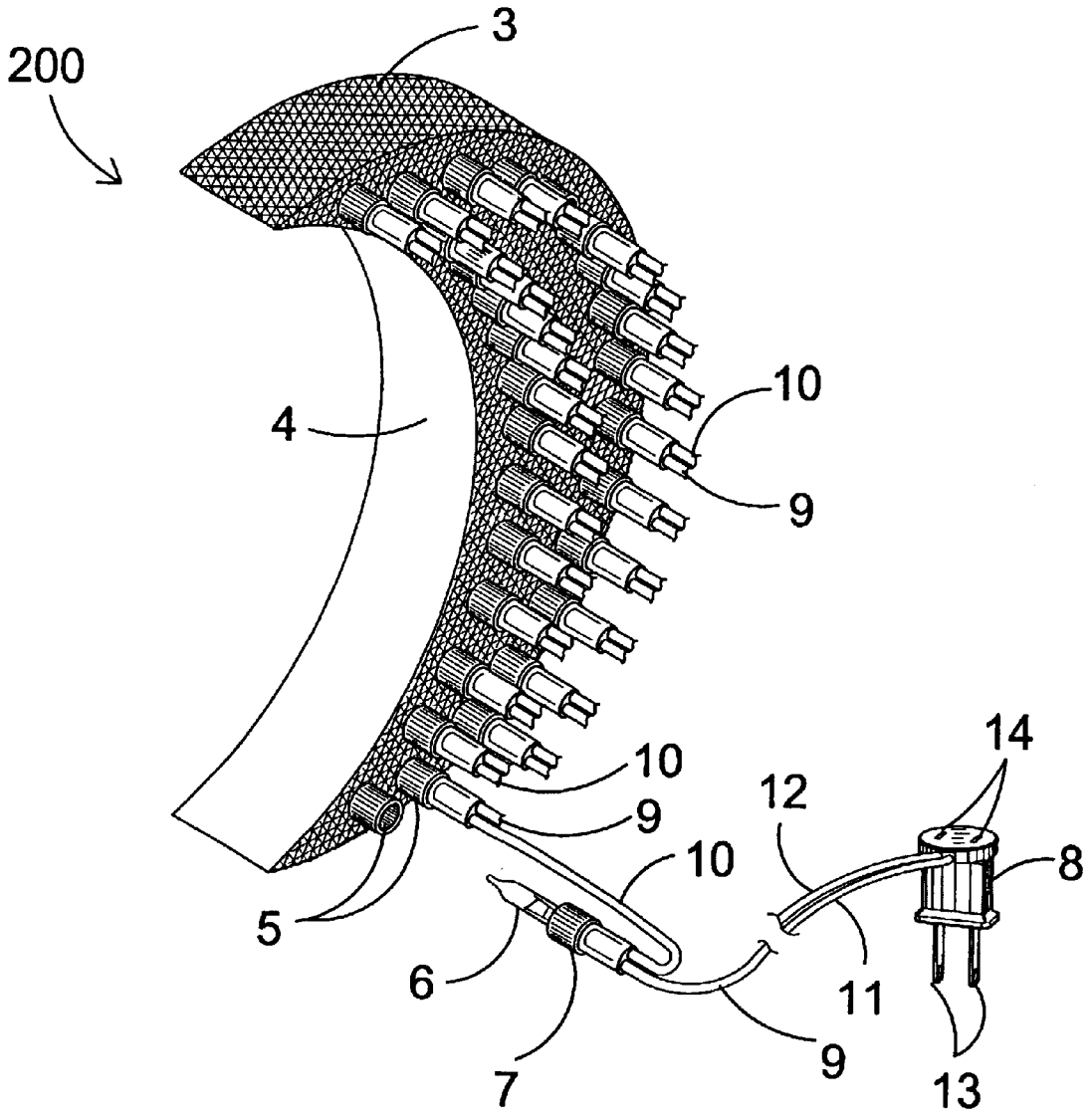
FIG. 2 is a perspective view of one possible C-shaped design layout of the present invention.

FIG. 2 is a perspective view 200 of one possible C-shaped design layout of a display apparatus of the present invention. Inner light diffusing body 4 conforms in shape to plastic housing 3 and is encased therein as shown. Plastic housing 3 could also be designed such that it comes in two or more snap-together parts (not shown), in which case inner light diffusing body 4 would be contained. Plastic housing 3 is made of a light diffusing material, clear or color. A plurality of bulb housing retaining sockets 5 are molded into plastic housing 3 to contain a plurality of light bulbs. Each light bulb 6 is contained within light bulb housing 7. Light bulbs 6 and light bulb housings 7 are electrically interconnected to one another via light bulb first power connection wire 9 and light bulb second power connection wire 10. Light bulbs are connected typically in series (as depicted) or in parallel depending on the design. Light bulb housing 7 inserts into plastic housing 3 via bulb housing retaining sockets 5 which hold each light bulb housing 7 in a fixed position. In this manner, each light bulb 6 can be removed from each respective bulb housing retaining socket 5 and then removed from light bulb housing 7 for replacement as required. Power plug 8 connects to a power source. Power plug 8 is connected to the light bulb wires via plug first power source wire 11 and plug second power source wire 12. Power plug 8 has power connection prongs 13 and receptacle prong receiving sockets 14 which can be used for hooking other displays in series.

Figure 3:
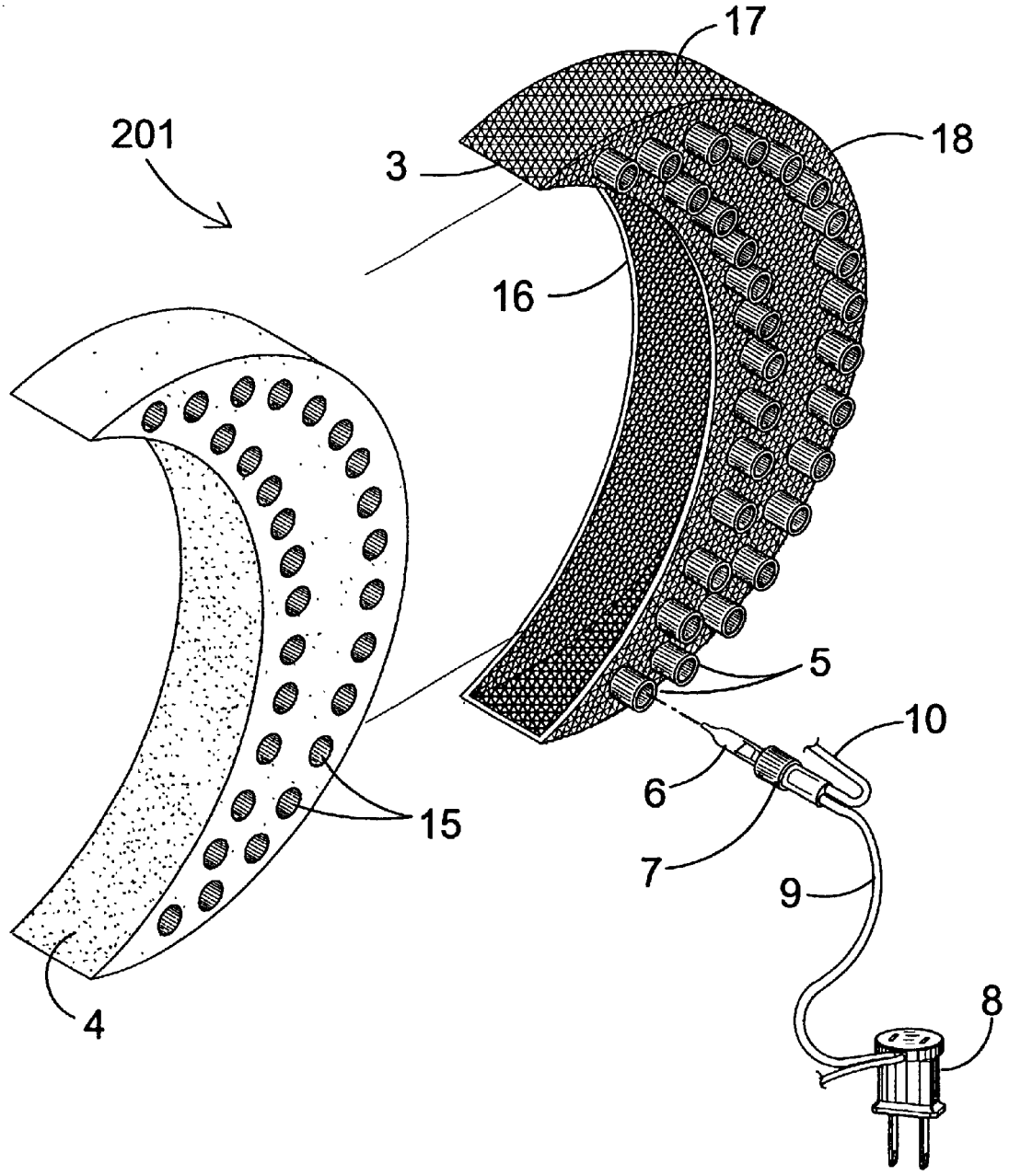
FIG. 3 is an exploded view of FIG. 2, one possible C-shaped design layout of the present invention.

FIG. 3 is an exploded view of FIG. 2, one possible C-shaped design layout light display apparatus of the present invention. C-shaped design layout 200 (FIG. 2) is shown as exploded view of C-shaped design layout 201. Inner light diffusing body 4 has bulb acceptance hole 15 to accept each light bulb 6. When each light bulb 6 is in a "power on" stage, light emitted from each light bulb 6 diffuses through inner diffusing body 4 toward plastic housing outer viewing surface(s) 16 and plastic housing side viewing surface 17. Plastic housing side viewing surface 17 can be designed to pass light or to block light depending on design requirements. The viewer can see light at one or both plastic housing viewing surfaces 16, 17. Plastic housing rear surface 18 would be typically coated to block light passage but could also be designed to pass light depending on design requirements.

Figure 4:
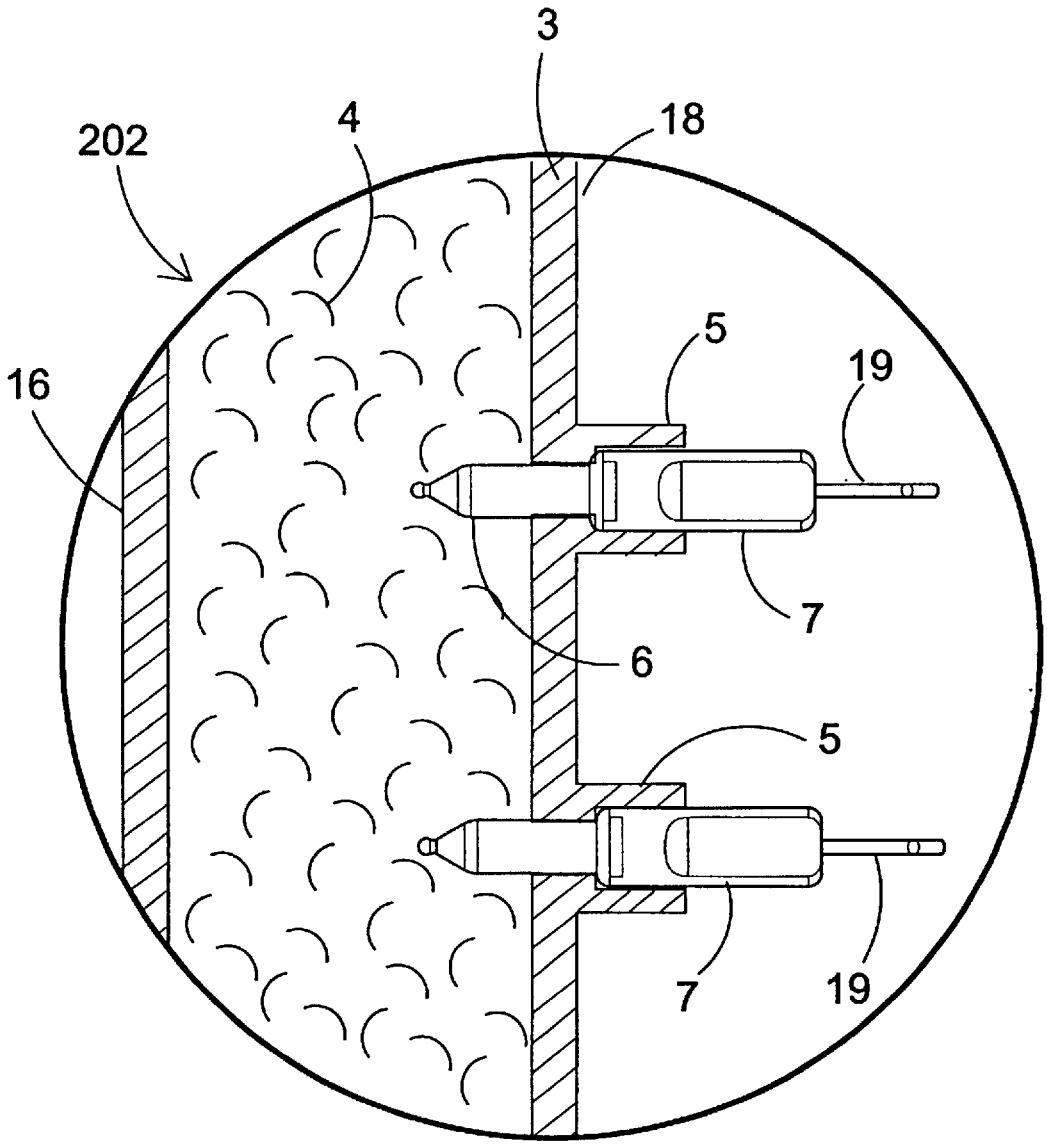
FIG. 4 is a side cross-sectional view of the present invention.

FIG. 4 is a side cross-sectional view 202 of bulb, housing and diffusion material of the present invention. Each light bulb 6 and respective light bulb housing 7 are contained within respective bulb housing retaining socket 5. Bulb housing retaining sockets are located on plastic housing rear surface 18. When light bulb 6 is powered "on", light is diffused through inner light diffusing body 4 to plastic housing viewing surface 16 which then passes light for display to a viewer. Connection pins 19 are attached to light bulb first and second power connection wires (not shown).

Figure 5:
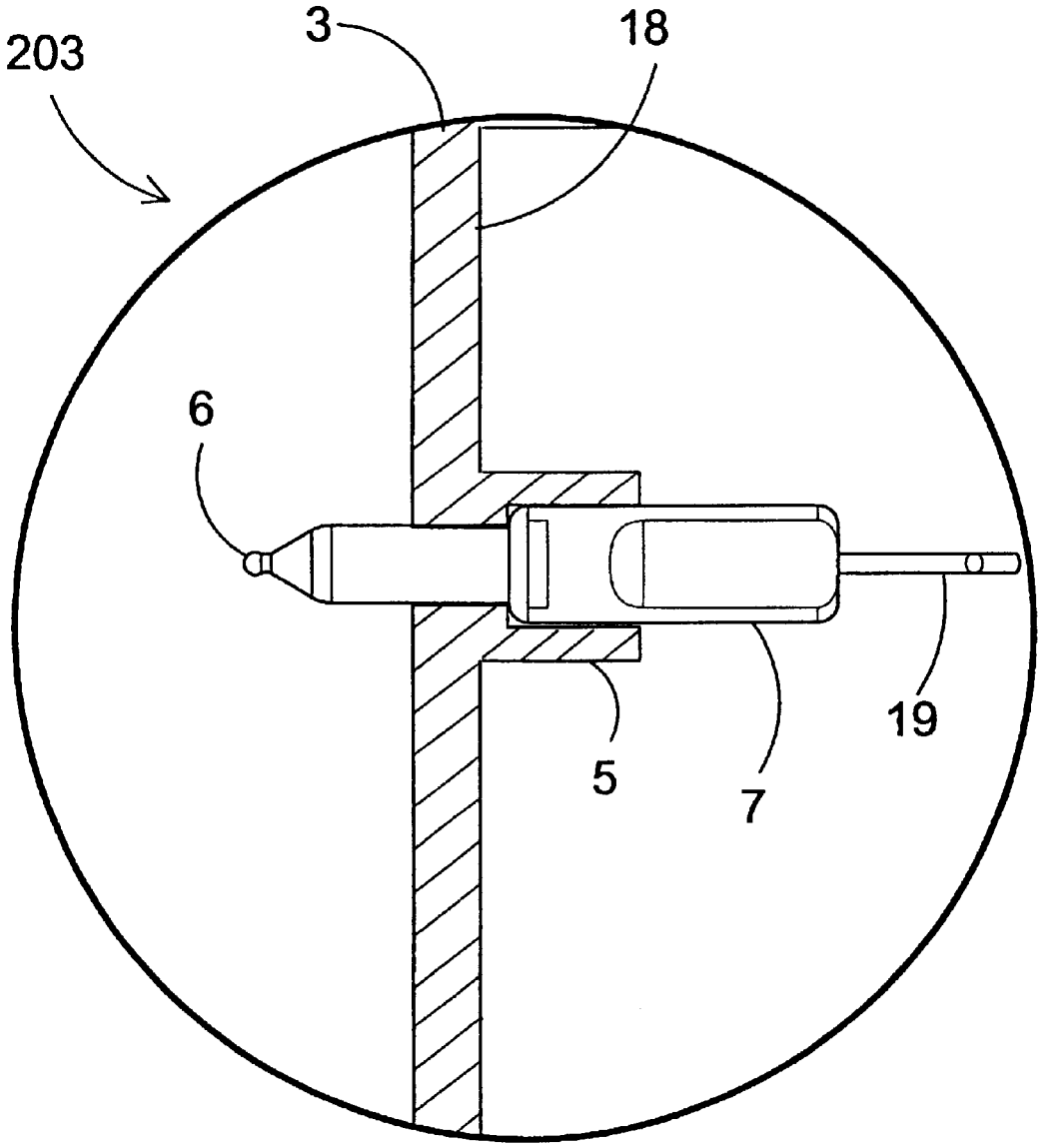
FIG. 5 is a side cross-sectional view of the plastic housing of the present invention.

FIG. 5 is a cross-sectional view 203 of plastic housing 3 with bulb 6 of the present invention. Shown is light bulb 6 seated into light bulb housing 7 and each is held into place via bulb housing retaining socket 7, which is located on plastic housing rear surface 18. Connection pins 19 are attached to light bulb first and second power connection wires (not shown). Each light bulb 6 (only one is shown) is positioned within a light diffusing material (not shown) having the light bulb 6 portion extending therein.

Figure 6:
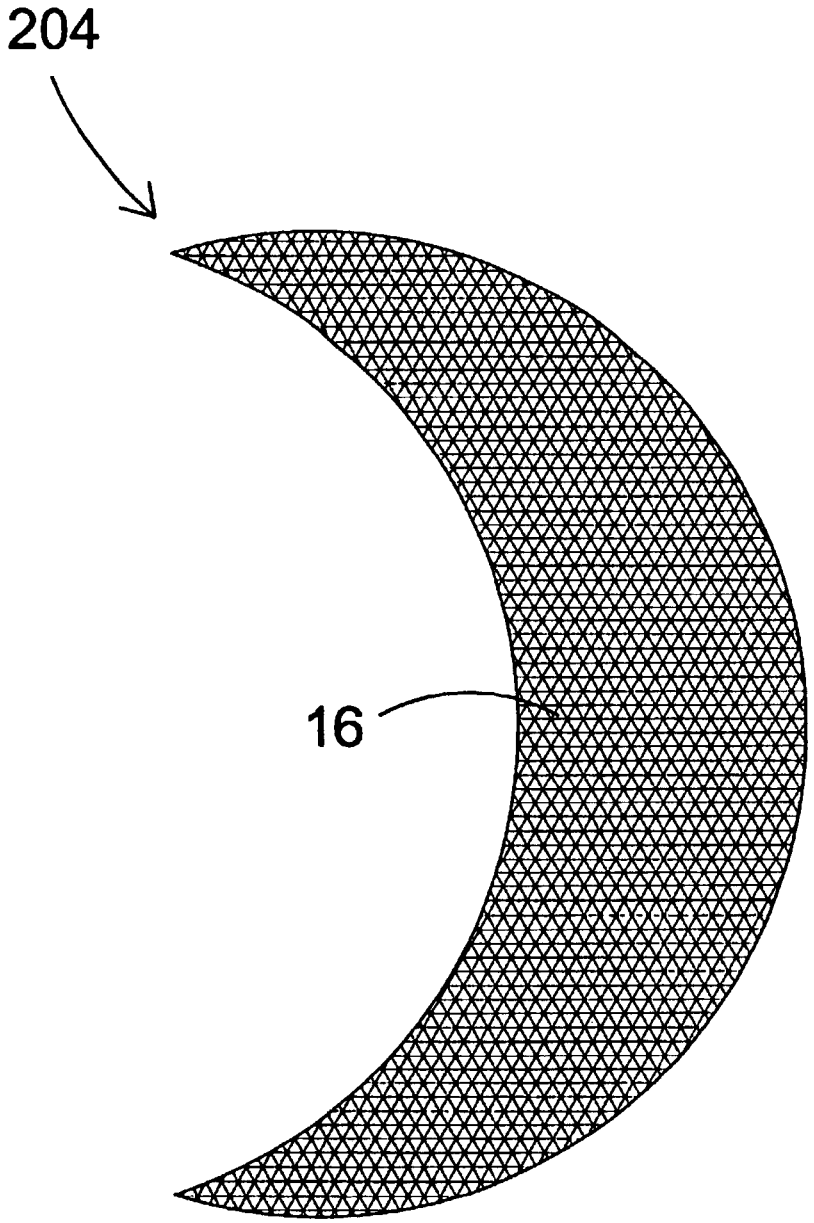
FIG. 6 is a frontal view one possible C-shaped design layout of the present invention.

FIG. 6 is a frontal view frontal view 204 of C-shaped design layout of the present invention. Outer plastic housing viewing surface 16 further diffuses and passes the diffused light from the plurality of internal light bulbs, which are diffused through inner light diffusing body (not shown) onto the viewer.

Figure 7:
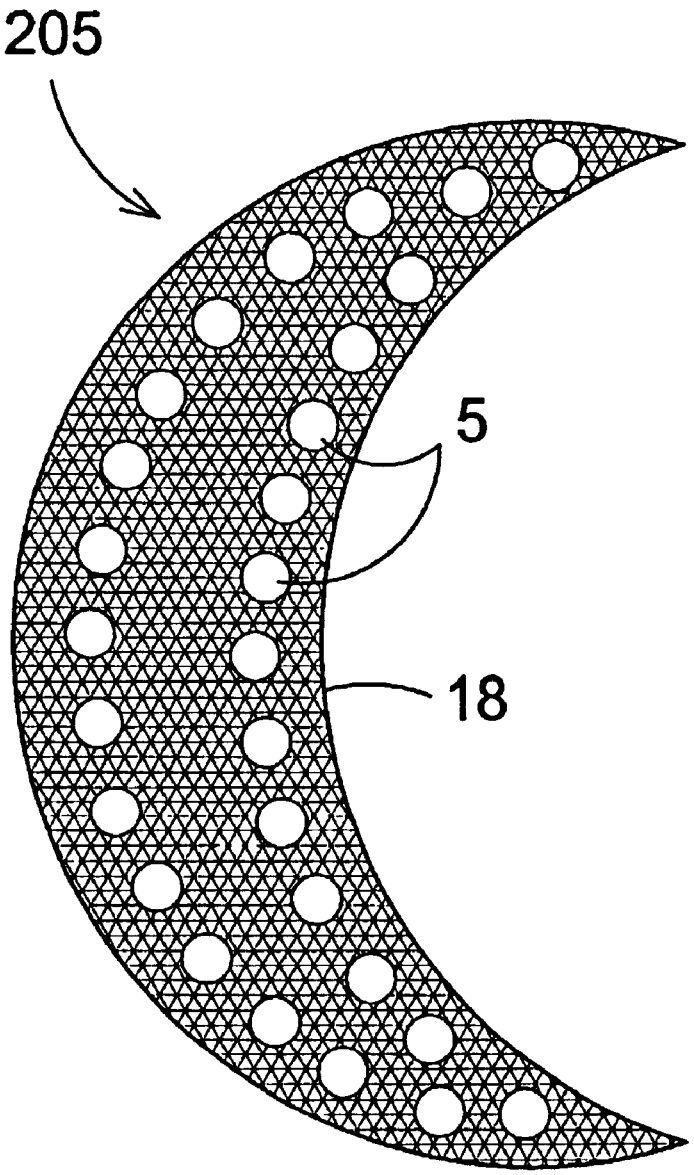
FIG. 7 is a rear view of one possible C-shaped design layout the present invention.

FIG. 7 is a rear view 205 of one possible C-shaped design layout the present invention. Plastic housing rear surface 18 can be specified to diffuse and/or pass light or be coated to block passage of light depending on design requirements. Bulb housing retaining sockets 5 are located on plastic housing rear surface 18 for retention of bulbs and bulb housings (not shown).

Figure 8:
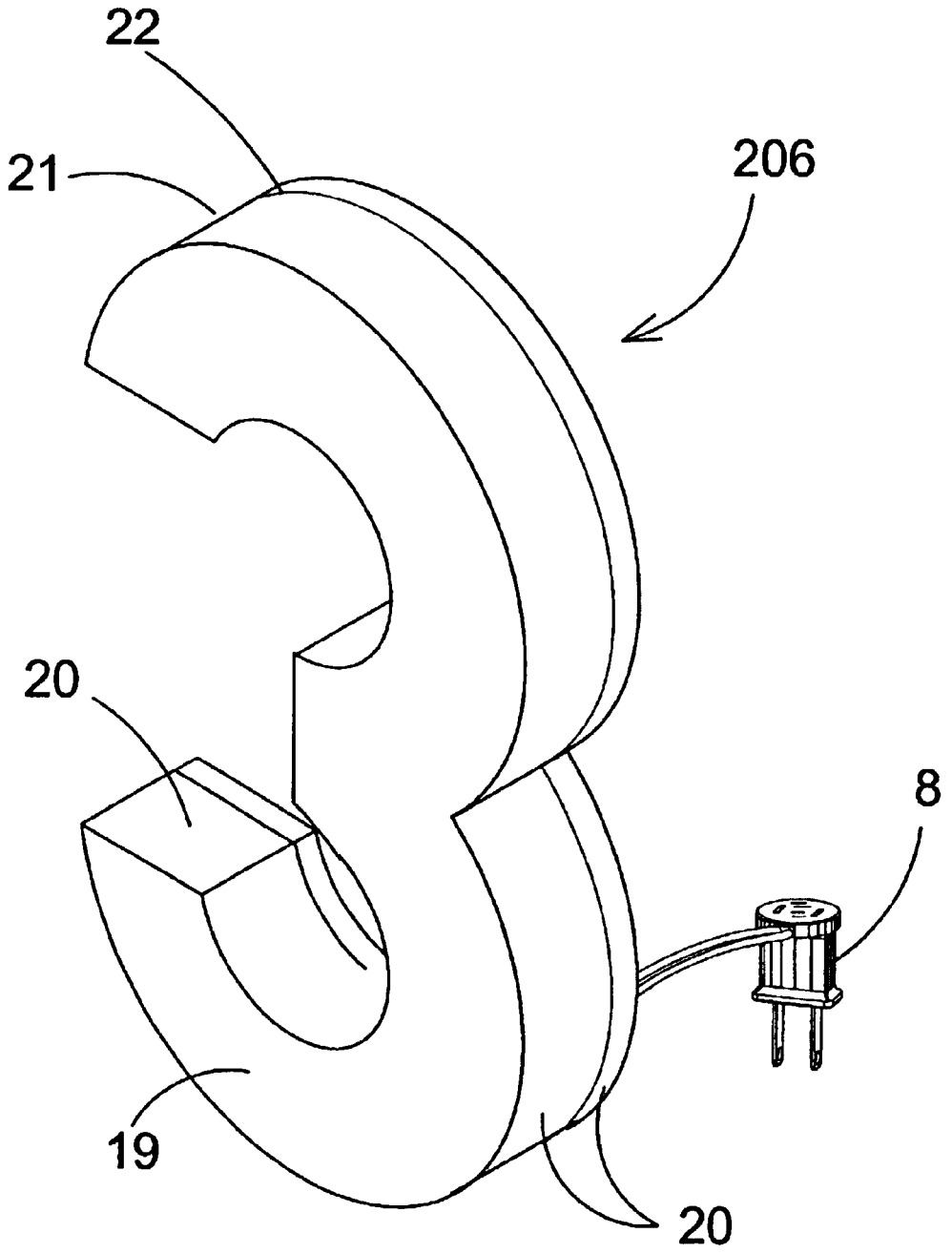
FIG. 8 is a frontal perspective view of one possible alternate "numeral three" shape of the present invention.

FIG. 8 is a frontal perspective view of one possible alternate "numeral three" design layout 206 display light apparatus of the present invention. This represents but one of may alternate layouts (numerals, letters, images, slogans, objects, etc.) of alternate shapes of the present invention. Shown is a fully assembled "numeral three" design composed of an outer plastic housing 21 and an inner plastic housing 22 which could snap together or clip together or connect by other means know in the art. Light bulbs 6 would mount as previously described with mounting sockets 5 which are on the back of inner plastic housing 22. Inner light diffusing material that conforms to the numeral three shape of the outer housing would diffuse light to all visible surfaces. Numeral three outer surface 19 and numeral three side surface 20 would pass and/or diffuse light to the viewer. Side surface 20 could be coated to block light depending on design requirements. The display light apparatus is comprised of a plurality of lights with light emitting bulbs positioned within a light diffusing material. The plurality of lights can be multi-colored, clear or of the same color, randomly flashing, sequentially flashing, or constantly "on" and provide a display lighting effect, which is pleasing when viewed.

Figure 9:
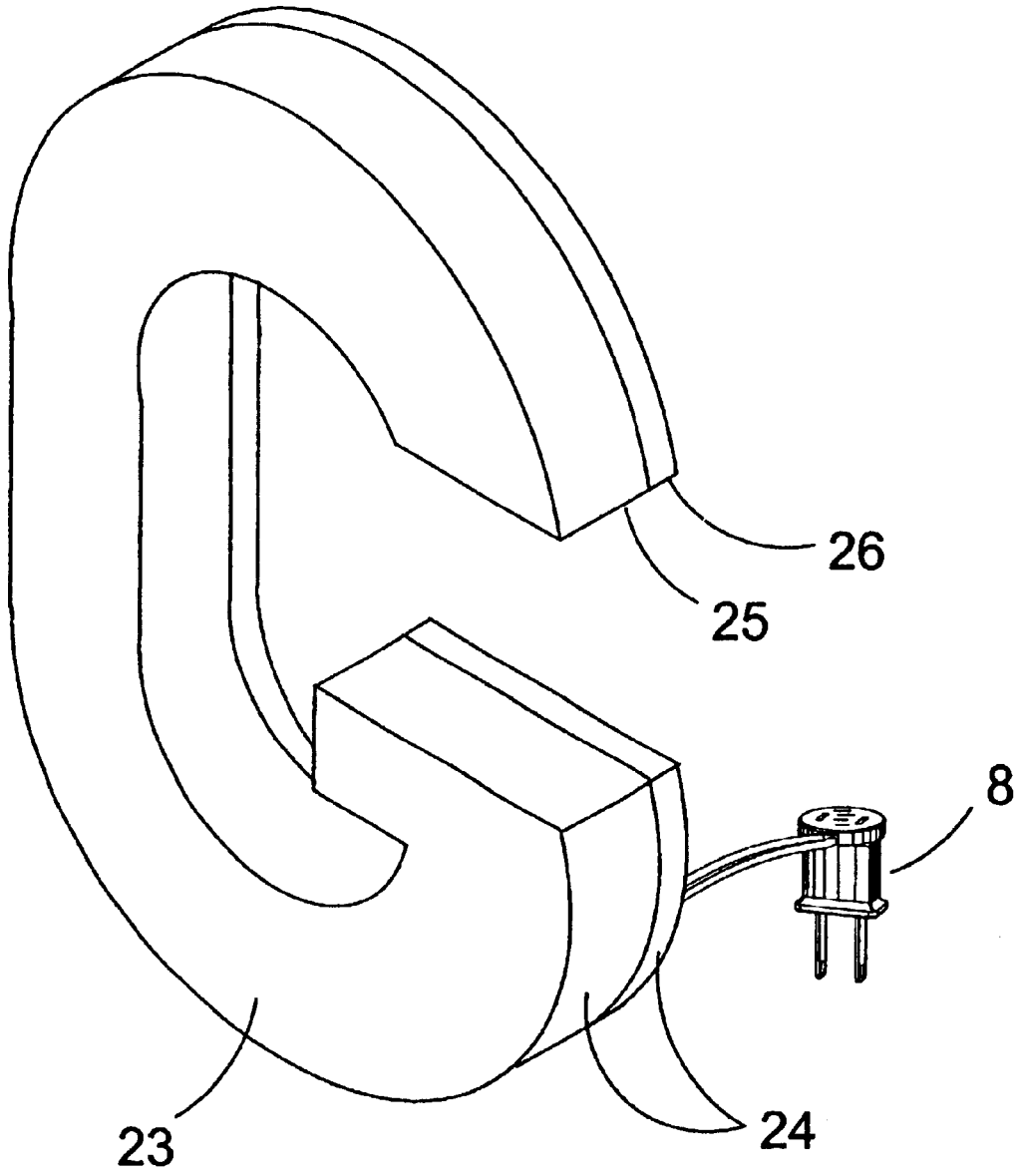
FIG. 9 is a frontal perspective view of an alternate letter "G" shape of the present invention.

FIG. 9 is a frontal perspective view of an alternate letter "G" shape display light apparatus of the present invention. This represents but one of may alternate layouts (numerals, letters, images, slogans, objects, etc.) of alternate shapes of the present invention. Shown is a fully assembled letter "G" design composed of an outer plastic housing 25 and an inner plastic housing 26 which could snap together or clip together or connect by other means know in the art. Light bulbs 6 would mount as previously described held by mounting sockets 5 on inner plastic housing 26. Inner light diffusing material that conforms to the numeral three shape of the outer housing would diffuse light to all visible surfaces. Letter "G" outer surface 23 and letter "G" side surface 24 would pass and/or diffuse light to the viewer. Letter "G" side surface 24 could be coated to block light depending on design requirements. The display light apparatus is comprised of a plurality of lights with light emitting bulbs positioned within a light diffusing material. The plurality of lights can be multi-colored, clear or of the same color, randomly flashing, sequentially flashing, or constantly "on" and provide a display lighting effect, which is pleasing when viewed.

What is claimed is:

1. A light display comprising:

an outer shell having a chosen shape;

said outer shell having a plurality of retaining sockets on a back side;

said outer shell having a central hollow, a front surface, a side surface, and a side opening:

an inner light diffusing body shaped to conform to the hollow and having a removable engagement into the side opening;

said inner light diffusing body having a plurality of holes aligned with the retaining sockets;

a string of lights; and wherein bulbs on the string of lights fit individually into the retaining sockets thereby illuminating an exposed side of the inner light diffusing body, and the outer shell.

2. The light display of claim 1, wherein the outer shell is made of plastic.

3. The light display of claim 2, wherein the chosen shape is a C and a concave segment of the C is the side opening.

* * * * *